US009793607B2

(12) United States Patent
Mcgough et al.

(10) Patent No.: US 9,793,607 B2
(45) Date of Patent: Oct. 17, 2017

(54) ANTENNA WITH QUARTER WAVE PATCH ELEMENT, U-SLOT, AND SLOTTED SHORTING WALL

(71) Applicant: Cisco Technology, Inc., San Jose, CA (US)

(72) Inventors: Erin Mcgough, Richfield, OH (US); Thomas Lutman, Richfield, OH (US)

(73) Assignee: Cisco Technology, Inc., San Jose, CA (US)

( * ) Notice: Subject to any disclaimer, the term of this patent is extended or adjusted under 35 U.S.C. 154(b) by 159 days.

(21) Appl. No.: 14/550,241

(22) Filed: Nov. 21, 2014

(65) Prior Publication Data

US 2016/0149303 A1 May 26, 2016

(51) Int. Cl.

| | |
|---|---|
| ***H01Q 1/10*** | (2006.01) |
| ***H01Q 5/357*** | (2015.01) |
| ***H01Q 13/16*** | (2006.01) |
| ***H01Q 9/04*** | (2006.01) |
| *H01Q 1/22* | (2006.01) |

(52) U.S. Cl.
CPC ..... *H01Q 5/357* (2015.01); *H01Q 9/0421* (2013.01); *H01Q 13/16* (2013.01); *H01Q 1/2291* (2013.01)

(58) Field of Classification Search
CPC ..... H01Q 1/22; H01Q 1/04; H01Q 5/357
USPC ..... 343/767
See application file for complete search history.

(56) References Cited

U.S. PATENT DOCUMENTS

| | | | | |
|---|---|---|---|---|
| 6,133,883 | A * | 10/2000 | Munson | H01Q 1/38 343/700 MS |
| 7,102,573 | B2 | 9/2006 | Morrow et al. | |
| 7,106,257 | B2 * | 9/2006 | Liu | H01Q 1/22 343/700 MS |
| 2002/0003499 | A1 * | 1/2002 | Kouam | H01Q 1/243 343/700 MS |
| 2003/0107518 | A1 | 6/2003 | Li et al. | |
| 2004/0041733 | A1 * | 3/2004 | Milosavljevic | H01Q 1/243 343/700 MS |
| 2009/0322637 | A1 * | 12/2009 | Livingston | H01Q 13/10 343/770 |
| 2011/0140977 | A1 * | 6/2011 | Yang | H01Q 1/2216 343/725 |

OTHER PUBLICATIONS

XinAn Liu, "Bandwidth-expanded U-slot Patch Antenna with Shorting Wall", Proceedings of International Symposium on Signals, Systems and Electronics (ISSSE2010), Sep. 2010, vol. 1, DOI: 10.1109/ISSSE.2010.5638213, 3 pages.

XinAn Liu, "Research of UWB U-slot Patch Antenna with Shorting Pin", Proceedings of the 2010 IEEE International Conference on Ultra-Wideband (ICUWB2010), Sep. 2010, vol. 2, DOI: 10.1109/ICUWB.2010.5614077, 3 pages.

(Continued)

*Primary Examiner* — Huedung Mancuso

(57) ABSTRACT

In one embodiment, an apparatus is formed using a quarter wave (QW) patch element with a U-Slot, a ground plane, and a slotted shorting wall. A feed line runs through the ground plane and connects to the QW patch element. The slotted shorting wall connects the QW patch element to the ground plane. The QW patch element, slotted shorting wall, and ground plane are composed of a single contiguous folded material.

12 Claims, 7 Drawing Sheets

(56) References Cited

OTHER PUBLICATIONS

A.K. Shackelford, et al., "U-slot patch antenna with shorting pin", Electronics Latters, vol. 37, No. 12, Jun. 7, 2001, 2 pages.
R. Chair, et al., "Wideband Half U-slot Patch Antennas with Shorting Pin and Shorting Wall", IEEE antennas and Propagation Society Symposium, vol. 4, Jun. 2004, DOI: 10.1109/APS.2004.1330260, 4 pages.
A B Nandgaonkar, et al., "A Modified Half U-Slot Microstrip Patch Antennas with Shorting Wall", 2007 IEEE Sarnoff Symposium, Apr. 30, 2007-May 2, 2007, DOI: 10.1109/SARNOF.2007.4567369, 4 pages.

* cited by examiner

ANTENNA WITH QUARTER WAVE PATCH ELEMENT, U-SLOT, AND SLOTTED SHORTING WALL

TECHNICAL FIELD

This disclosure relates in general to antennas and, more particularly, to dual-broadband antennas.

BACKGROUND

Dual-broadband antennas present a variety of challenges to the operation at each broadband frequency. The quarter wave (QW) patch mode antenna is well-known for its wide-beam, broadside pattern and is desirable in a dual-broadband antenna. Typically, U-Slot antennas equipped with a shorting wall or shorting pin (along the symmetry line of the U-Slot) have two near end-fire lobes, which result in an elevation plane pattern similar to that of a monopole. The use of a monopole elevation pattern is not desirable for wall-mounted deployments of antennas, because wall-mounted deployments require a broadside radiation pattern to be practicable.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts.

DETAILED DESCRIPTION

A dual broadband antenna is formed that combines a QW patch antenna for lower band operation with a U-Slot antenna for higher band operation through the use of a slotted shorting wall. The outer stubs of a slotted shorting wall force high-current points at the corners of the QW patch element so that the QW mode at a low band may be realized, while the inner stub of the slotted shorting wall performs the wide band impedance match at a wide band. The inner stub helps pull the operation pattern so that the pattern falls in the broadside direction. In a low cost implementation, a low-profile, dual-broadband antenna is formed by cutting slots in a single piece of brass. By folding at the slotted wall, both the radiation portions and the ground plane with shorting are created. The resulting structure radiates a broadside pattern independent of any external ground plane or reflector.

In one embodiment, an apparatus is formed using a QW patch element with a U-Slot, a ground plane, and a slotted shorting wall. A feed line runs through the ground plane and connects to the QW patch element. The slotted shorting wall connects the QW patch element to the ground plane. In some embodiments, the QW patch element, slotted shorting wall, and ground plane are formed from a single contiguous folded material.

In another embodiment, a method includes receiving electric current through a feed line, wherein the feed line is connected to a QW patch element with a U-Slot. Through the feed line the electric current excites the QW patch element. The electric current exciting the QW patch element results in the broadcasting of low band and wide band frequencies. The method impedes the electric current from both the low band and the wide band by slots in a shorting wall connecting the QW patch element with the ground plane.

In yet another embodiment, a system is formed with a transceiver, a feed line connected with the transceiver, and a dual-broadband antenna connected with the transceiver by the feed line. The dual-broadband antenna includes a patch antenna with a first side edge, a ground plane with a second side edge, and a slotted shorting wall. The slotted shorting wall is connected to the side edge of the patch antenna and the side edge of the ground plane. The slotted shorting wall has at least three conductive portions and at least two non-conductive slots.

A solution that successfully combines the U-Slot and QW patch antennas takes the form of a slotted shorting wall. The outer stubs force high-current points at the corners of the patch so that the QW mode at 2.4 GHz may be realized, while the inner stub performs the wide-band impedance match at 5 GHz and helps pull the pattern so that the pattern falls in the broadside direction.

Figure 1:
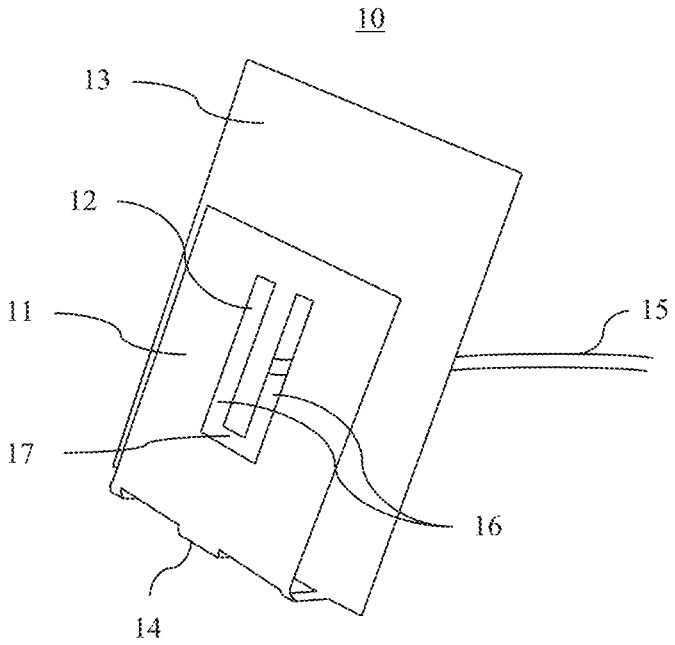
FIG. 1 is a perspective view of one embodiment of an antenna with a QW patch element having a U-Slot and a slotted shorting wall.
Figure 2:
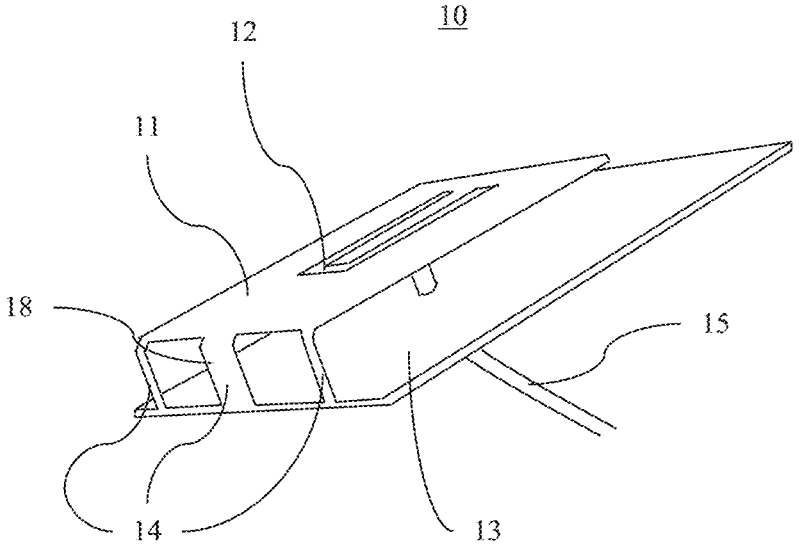
FIG. 2 is a different perspective view of the embodiment of the antenna with a QW patch element having a U-Slot and a slotted shorting wall of FIG. 1.

FIGS. 1 and 2 show an apparatus 10 that may be operable as a dual-broadband antenna. The apparatus 10 may be an antenna configured for wireless reception and/or transmission. The apparatus 10 includes a QW patch element 11, a U-Slot 12, a ground plane 13, a slotted shorting wall 14, and a feed line 15. Additional, different, or fewer components may be provided. For example, modified patch antennas designs or slot antennas designs can be used as the basis for the QW patch element 11 or U-Slot 12, respectively. As another example, the ground plane 13 may be external to the apparatus 10, such as being an added ground plane formed from the same or different material but not of the same sheet of material.

The apparatus 10 contains a QW patch element 11 with a U-Slot 12. This arrangement allows for operation at two different antenna frequencies, a low band, and a high band. In one embodiment, the QW patch element 11 operates at the low band which is 2.4 GHz center frequency, and the U-Slot 12 operates at the high band which is 5 GHz center frequency.

The QW patch element 11 has a square or rectangular shape, but other shapes may be used. The QW patch element 11 is sized for operation within a housing and/or at a desired center frequency.

The U-Slot 12 includes two parallel slots 16 connected by one other slot 17. The slots are formed in the QW patch element 11. The connecting slot 17 sits perpendicular to the parallel slots 16 and may be of varying width in relation to the parallel slots 16. Other arrangements than a U-pattern may be used, such as an H pattern. Any widths or lengths of the primary slots and/or connecting slot may be used.

The apparatus 10 also contains a connected ground plane 13. In one embodiment, the ground plane 13 has a same rectangular shape as the QW patch element 11, but is larger or extends beyond the QW patch 11 along three sides.

In some embodiments, the ground plane 13 is formed of the same material as the QW patch element 11. In some embodiments, the ground plane 13 may be formed from different material. In some embodiments, the ground plane 13 is formed from a same sheet of material from which the QW patch element 11 is formed. In this way cost savings may be achieved by not having to affix an external ground plane to the QW patch element 11, because all of the components may be fabricated from one contiguous piece of material. In alternative embodiments, the ground plane 13 is formed from a separate sheet of material and bonded to or held in place relative to the apparatus 10.

The ground plane 13 is physically affixed and electrically shorted to the QW patch element 11 by the slotted shorting wall 14. The slotted shorting wall 14 connects the QW patch element 11 with the U-Slot 12 to the ground plane 13. The slotted shorting wall 14 includes multiple strips, resulting in multiple slots between the QW patch element 11 and the ground plane 13. There are slots or gaps along the shorting wall rather than a solid wall. Any number of slots and corresponding stubs or strips forming the slotted shorting wall may be used. Each slot is of any width or length. As shown in FIG. 2, the slots extend all the way between the QW patch 11 and the ground plane 13. In alternative embodiments, the slots have a lesser extent or height so that the shorting wall includes wall portions extending from the QW patch element 11 and/or grounding plane 13 to the slot portion. The slots are formed as gaps of air or gas. Alternatively, the slots are formed from a non-conductive or lesser conductive material than that of the strips.

In the embodiment shown in FIGS. 1 and 2, the slotted shorting wall 14 has three conductive portions and two non-conductive slots with one conductive portion connected to the center of a side of the QW patch element 11, and the other conductive portions connected to the corners of the same side of the QW patch element 11. Additional conductive portions and slots along the length of the wall may be provided. As depicted, the conductive portion connected to the center of the side of the QW patch element 11 is centered on the U-Slot 12 and is smaller than the width of the U-Slot 12. The U-slot 12 may be as wide as the connecting slot 17, and the conductive center stub may have a greater or same width as the U-slot. Off-center alignment of the conductive center stub relative to the U-slot may be used. As depicted, the conductive portions connected to the corners of the QW patch 11 are narrower than the conductive portion connected to the center of the QW patch 11, but, in some embodiments, may have a same or greater width.

The slotted shorting wall 14 is optimized to permit the wideband operation over both bands and to produce some downtilt in the wide band elevation plane pattern. The pattern shaping results in an antenna that is well-suited for integration into wall-mounted access points, but may be used in other arrangements.

In some embodiments, the QW patch element 11 with the U-slot 12, the slotted shorting wall 14, and the ground plane 13 are formed from a same piece of material. In other embodiments, one or more components of the apparatus is constructed from different pieces of material and connected or held in place relative to each other.

The apparatus 10 also includes a feed line 15 which is passes through the ground plane 13 and connects to the QW patch element 11. The feed line 15 is electrically isolated from the ground plane 13, such as having an insulated conductor passing through a hole in the ground plane 13. The conductor of the feed line electrically connects with the QW patch element 11, such as at a center of the protrusion formed by the U-slot 12 (i.e., the center of the "U"). The feed line 15 may be soldered to the back of the ground plane 13, and the back of the strip of the QW patch element 11 which forms the center of the U-Slot 12. In other embodiments, the feed line 15 may be soldered directly to the center of the U-Slot 12. The feed line 15 is responsible for routing signals to or from the apparatus so that the apparatus may function as an antenna.

Figure 3:
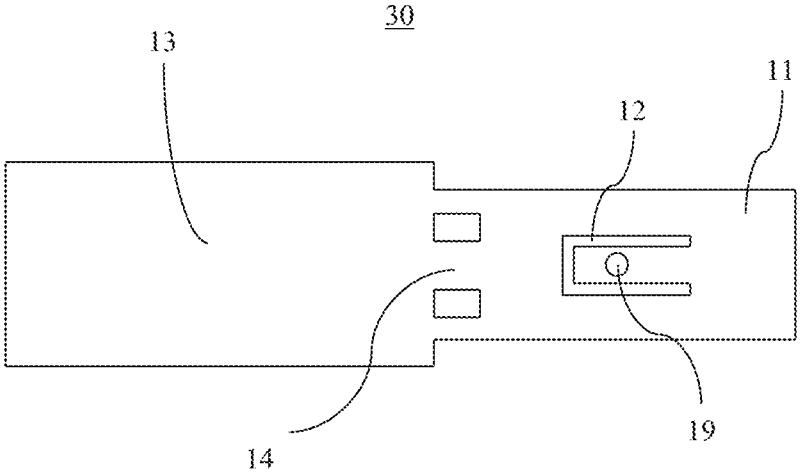
FIG. 3 is a view of one embodiment of a slotted material for use as an antenna prior to being folded.

In some embodiments, the QW patch 11 element, slotted shorting wall 14, and ground plane 13 are composed of a single contiguous folded material, such as a sheet of brass cut, drilled, or otherwise formed with the desired shape. FIG. 3 shows a slotted material 30 that may be folded for use as a dual-broadband antenna. The material can be brass or other conductive material. The slotted material 30 shows the slotted shorting wall 14 in relation to the QW patch element 11, the ground plane 13, and the U-slot antenna 12. Additionally, the hole 19 for the feed line 15 in the QW patch element 11 is also shown. This structure is cast, molded, machined, cut, or otherwise formed as a flat sheet. The flat sheet may be folded along two lines to create the apparatus of FIGS. 1 and 2. This fabrication affords cost savings not realized when each component is fabricated from a separate material. In one embodiment the apparatus 10 is composed of a single contiguous folded material which is folded at least twice. In another embodiment, the single contiguous folded material may be folded more than twice, or less than twice. In one embodiment the folded material is folded such that the QW patch element 11 and grounding plane 13 are parallel to each other with the slotted shorting wall 14 connecting the two components. Other manufacturing may be used, such as separately forming and bonding different pieces together.

Figure 6:
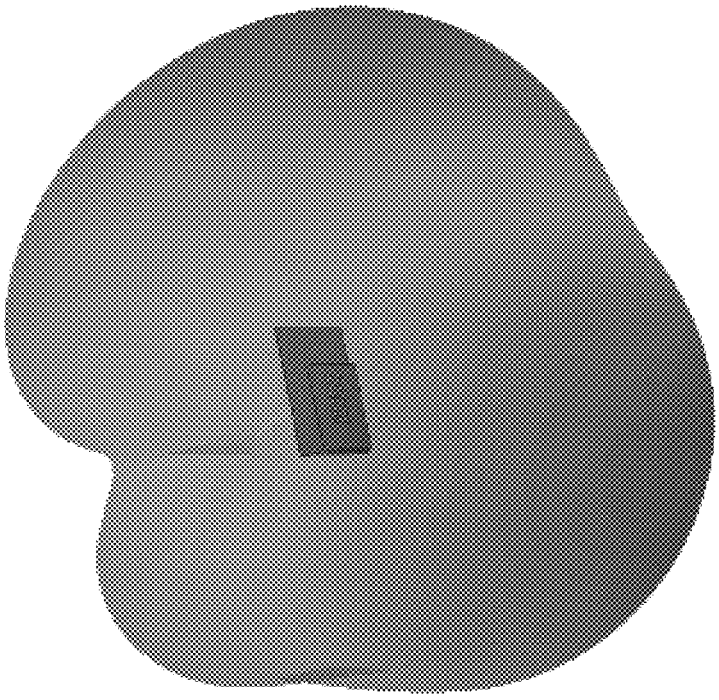
FIG. 6 shows an example antenna pattern of the apparatus of FIG. 1 operating at 5 GHz.
Figure 7:
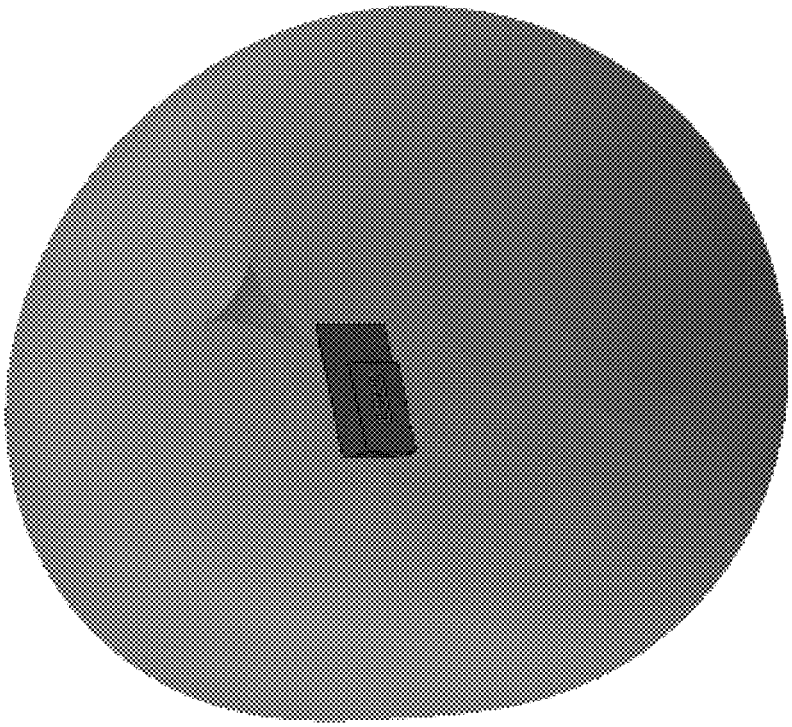
FIG. 7 shows an example antenna pattern of the apparatus of FIG. 1 operating at 2.4 GHz.

The apparatus 10 functions as a dual-broadband antenna. In one embodiment, the upper band is centered at 5 GHz or about 5 GHz, and the low band is centered at 2.4 GHz or about 2.4 GHz. "About" is used to account for tolerances in structure and electronics operation. The 5 GHz current reacts primarily or only to the shorting wall closest to the U-Slot 12. The width of the shorting wall adjacent to the U-slot 12 is optimized to sustain the desired impedance match. The strong electric field lines in the direction of the center shorting wall (from the radiating edges of the slot) help direct the antenna pattern so that the far-field pattern radiates broadside with the peak gain occurring about 20 degrees below the horizon. FIG. 6 shows an example antenna pattern of the apparatus operating at 5 GHz. At 2.4 GHz, to ensure that the electric field is zero along the entire width of the patch, the shorting posts are placed at the corners of the patch QW patch element 11. This results in a symmetrical, wide-beam radiation pattern and a desired impedance match. FIG. 7 shows an example antenna pattern of the apparatus operating at 2.4 GHz. Thus, the middle and end portions of the slotted shorting wall 14 serve different purposes, and together, result in a single shorting wall with slots.

As shown in FIG. 2, the slotted shorting wall 41 extends from the QW patch element 11 all the way down to the ground plane 14. The stubs of the slotted shorting wall 14 connect on the same edge of the QW patch element 11 at the center and corners of the outer edge. In one embodiment, the center stub 18 is the same width as the U-slot 12 on the QW patch element 11. In other embodiments the center stub 18 may be wider, or narrower, than the U-slot 12 width.

Figure 4:
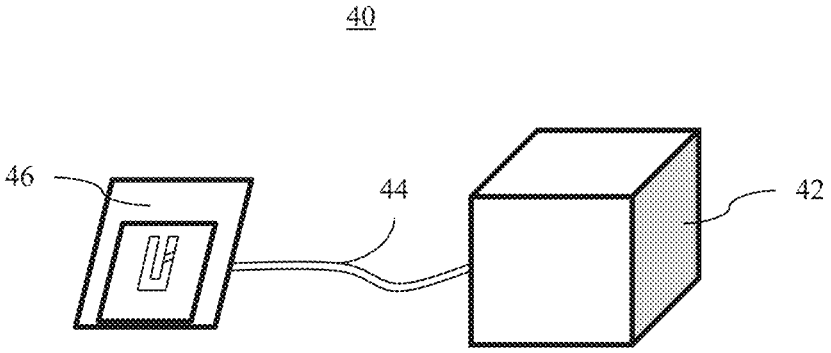
FIG. 4 shows one embodiment of a system for operating a dual-broadband antenna.

FIG. 4 shows a system 40 configured to operate as a dual-broadband antenna. The system 40 may be an antenna configured for wireless reception and/or transmission. The system 40 includes a transceiver 42, a feed line 44, and a dual-broadband antenna 46. Additional, different, or fewer components may be provided. For example, the transceiver 42, feed line 44, and dual-broadband antenna 46 are all contained within the same structure, such as an access point housing. Alternatively, the antenna 46 is positioned on a wall, pole, or other structure, the feed line 44 connects over any distance (e.g., meters, tens of meters, or thousands of meters) to the transceiver 42, and the transceiver 42 is in a building or different housing than the antenna 46.

In one embodiment, the system 40 is a wall mounted access point. This configuration allows for increased coverage of broadcasting or receiving at the low band and high band of the dual-broadband antenna 46. In another embodiment, the system 40 is mounted sideways and oriented outside. In other embodiments, the dual-broadband antenna 46 is angled at an angle different from perpendicular to the ground.

The transceiver 42 is capable of both transmitting and receiving at low band and high band frequencies. The transceiver 42 may be connected to the system 40 via the feed line 44, or the transceiver 42 may be a part of the system 40 integrated into one piece. In alternative embodiments, a separate transceiver is provided for each of the dual bands. In yet other alternative embodiments, just a transmitter or just a receiver is used.

The feed line 44 connects the transceiver 42 and the dual-broadband antenna 46. The feed line 44 is a coaxial cable, but a twisted pair, ribbon, or other conductor with or without insulation may be used. The feed line 44 delivers power or signal to and/or from the transceiver 42 to the dual-broadband antenna 46. In other embodiments, the feed line 44 receives power from a power source external to the system 40, and does not receive its power from the transceiver 42.

The dual-broadband antenna 46 connects with the transceiver 42 by the feed line 44. The dual-broadband antenna 46 includes a patch antenna with a first side edge, a ground plane with a second side edge, and a slotted shorting wall. The patch antenna includes a QW patch element or other patch element for operating at one frequency band, and a U-slot or other slot structure for operating at a different frequency band. In other embodiments, the dual-broadband antenna 46 makes use of an antenna element other than a patch antenna element. The slotted shorting wall connects to the first edge of the patch antenna and the second edge of the grounding plane. Shorting pins may also be provided. The slotted shorting wall has at least three conductive portions and at least two non-conductive slots of any size. The dual-broadband antenna 46 is capable of broadcasting both a low band and a high band at the same time or at other times. The slotted shorting wall allows for the operation at a low band and a high band.

In one embodiment of the system 40, the dual-broadband antenna 46 has a slotted shorting wall with one conductive portion connected to the center of the first edge of the patch and one conductive portion connected to each corner of the first edge. This results in a total of three conductive portions, allowing for the impedance of the dual-broadband frequencies emanating from the dual-broadband antenna 46. In another embodiment, the conductive portion connected to the center of the first edge of the patch antenna is wider than the conductive portions connected to each corner of the first edge.

Figure 5:
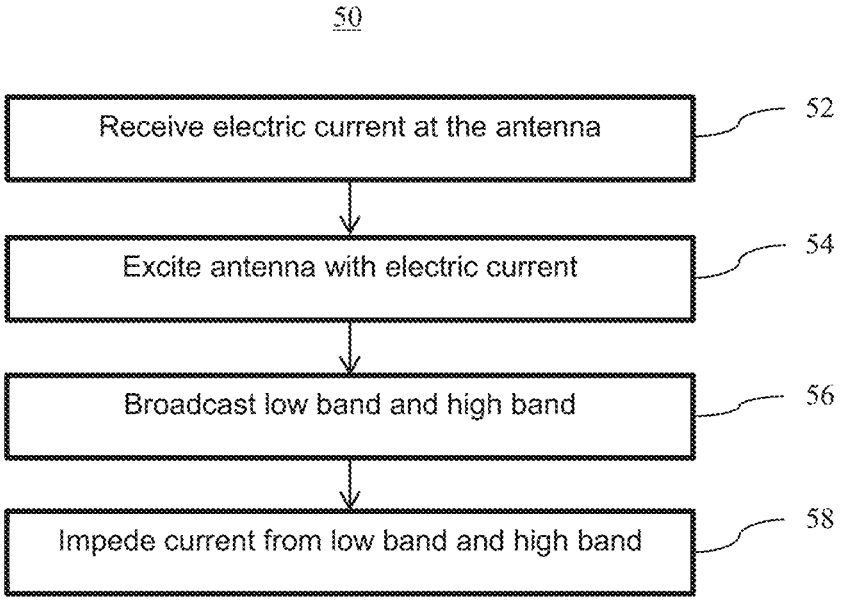
FIG. 5 is a flow chart diagram of one embodiment of a method for operating a dual-broadband antenna.

FIG. 5 shows a method for operating an antenna, such as a dual-broadband antenna. The method is implemented using the apparatus of FIGS. 1 and 2, the system of FIG. 4, or another antenna. The method may be performed with any antenna having a slotted shorting wall. The edge of the antenna rather than using posted spaced from the edge of the antenna shorts to ground. Along that shorting edge, the conductors are separated by gaps, providing a slotted shorting wall.

Additional, different, or fewer acts may be provided. For example, separate acts are provided for broadcasting a low and high bands 56, or impeding the current from the low band and wide band 58. In another example, the receiving electric current 52 act, and the exciting the QW patch element 54 act are performed in the same act. In yet another example, the acts are directed to receiving signals instead of transmitting signals. Signals at the dual bands are received at the antenna. Act 58 occurs while the signals are routed to receive circuits through the feed line. In one embodiment the acts are performed by a dual-broadband antenna used as a transmitter. In another embodiment, acts are performed by a dual-broadband antenna used as a receiver. In yet another embodiment, the acts are performed by a dual-broadband antenna used with a transceiver for both transmit and receive operation.

The acts are performed in the order shown (top to bottom) or a different order. In one embodiment, the acts are performed simultaneously, such as acts 56 and 58 occurring simultaneously in response to simultaneous acts 52 and 54.

In act 52, the antenna receives electric current through a feed line, such as the feed line 15 in FIG. 1 or 2. In one embodiment, the feed line is connected to an external power source which supplies the energy to the feed line. In another embodiment, such as the system of FIG. 3, the feed line is connected to a transceiver 32. The feed line routes the electric current to the QW patch element and U-slot. The electronic current is a signal to begin or cause transmission. This signal is received by the QW patch element and U-slot.

In act 54, the electric current received by antenna in act 52 excites the QW patch element and the U-slot with the electric current. The feed line provides the signal to the antenna so that the antenna operates.

In act 56, the antenna broadcasts at the low band and/or at the high band. In one embodiment, the broadcasting 56 comprises broadcasting the low band as 2.4 GHz and/or the high band as 5 GHz, but other frequencies may be used. In another embodiment, the broadcasting 56 comprises broadcasting the bands in their pure mode. By the use of the antenna with the slotted shorting wall, the low band and/or wide band are broadcast with minimal distortion to their broadcast patterns and thus are broadcast in their pure mode.

The broadcasting of both bands allows for the antenna to function as a dual-broadband antenna. If the signal is at the low band and not the high band, then the antenna broadcasts at the low band and not the high band. If the signal is at the high band and not the low band, then the antenna broadcasts at the high band and not the low band. If the signal has components at both bands, then the antenna broadcasts at both bands.

In one embodiment, broadcasting in act 56 provides a broadside pattern. FIG. 6 shows an example antenna pattern of the apparatus operating at 5 GHz. FIG. 7 shows an example antenna pattern of the apparatus operating at 2.4 GHz. The broadside pattern may be effective for outdoor deployments of antennas to reach a broad audience of receivers. A broadside pattern is in contrast to an omnidirectional pattern broadcast. The broadside pattern may be oriented relative to likely user locations by wall mounting or mounting sideways on a pole. By wall mounting or mounting the antenna indoors or outdoors with a plane of the antenna vertical or within 30 degrees of vertical, the broadside pattern may be directed to cover a desired area or volume along a generally horizontal plane. This sideways type of broadcast helps to direct the beam pattern towards the horizon for greater coverage. Alternatively, in another embodiment the method broadcasts the low band and wide band in other patterns.

In act 58, the current from the low band and high band signals are impeded by one or more slots in the shorting wall. The slotted shorting wall, such as the slotted shorting wall 14 of FIG. 1, is optimized to ensure that the necessary level of impedance occurs for both the low band and the high bands. In particular, the outer stubs of the slotted shorting wall force high-current points at the corners of the patch so that the QW mode at 2.4 GHz may be realized. For 5 GHz signals, the high current points limit operation of the QW patch element. The inner stub of the slotted shorting wall performs the wide-band impedance match at 5 GHz and helps pull the pattern so that the pattern falls in the broadside direction. During 2.4 GHz operation, the slotted shorting wall limits operation of the U-slot. In other embodiments, the slotted shorting wall may have multiple stubs beyond the two outer stubs at the corner and the one inner stub. Any arrangement of shorting or slotted conductors may be used to allow antenna operation at desired bands.

While the invention has been described above by reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

What is claimed is:

1. An apparatus comprising:

a quarter-wave (QW) patch element with a U-Slot;

a ground plane;

a feed line through the ground plane and connected to the QW patch element;

a slotted shorting wall connecting the QW patch element to the ground plane, wherein the slotted shorting wall comprises at least three conductive portions and at least two non-conductive slots with one conductive portion connected to a center of a side of the QW patch element, and the other conductive portions connected to corners of the same side of the QW patch element; and wherein the QW patch element, the slotted shorting wall, and the ground plane are composed of a single contiguous folded material.

2. The apparatus of claim 1, wherein the conductive portion connected to the center of the side of the QW patch element is centered on the U-Slot and smaller than a width of the U-Slot.

3. The apparatus of claim 1, wherein the conductive portions connected to the corners of the side of the QW patch element are narrower than the conductive portion connected to the center of the side of the QW patch element.

4. The apparatus of claim 1, wherein the feed line is connected to a strip of the QW patch element which forms a center of the U-Slot.

5. The apparatus of claim 1, wherein the folded material is folded at least twice.

6. The apparatus of claim 1, wherein the folded material is folded such that the QW patch element and the grounding plane are parallel to each other with the slotted shorting wall connecting the QW patch element and the grounding plane.

7. The apparatus of claim 1, wherein the U-Slot comprises two QW length slots connected by one other slot.

8. A system comprising:

a transceiver;

a feed line connected with the transceiver; and a dual-broadband antenna connected with the transceiver by the feed line, and comprising a patch antenna with a first side edge, a ground plane with a second side edge, and a slotted shorting wall, the slotted shorting wall connected to the first edge and the second edge, the slotted shorting wall having at least three conductive portions and at least two non-conductive slots.

9. The system of claim 8, wherein the system is a wall mounted access point.

10. The system of claim 9, wherein the system is mounted sideways and oriented outside.

11. The system of claim 8, wherein the slotted shorting wall has one conductive portion connected to a center of the first edge and one conductive portion connected to each corner of the first edge.

12. The system of claim 11, wherein the conductive portion connected to the center of the first edge is wider than the conductive portion connected to each corner of the first edge.

* * * * *